US008297436B2

(12) United States Patent
Gattefosse et al.

(10) Patent No.: US 8,297,436 B2
(45) Date of Patent: Oct. 30, 2012

(54) BLISTER PROTECTION SLEEVE INCLUDING AUTOMATIC LOCKING MEANS THAT CAN BE UNLOCKED BY TORSION

(75) Inventors: Herve Gattefosse, Antony (FR); Patrick Sivera, Beauvoir en Royans (FR)

(73) Assignee: Sanofi, Paris (FR)

( * ) Notice: Subject to any disclaimer, the term of this patent is extended or adjusted under 35 U.S.C. 154(b) by 34 days.

(21) Appl. No.: 12/529,158

(22) PCT Filed: Mar. 6, 2008

(86) PCT No.: PCT/EP2008/052715

§ 371 (c)(1),
(2), (4) Date: Aug. 28, 2009

(87) PCT Pub. No.: WO2008/113694

PCT Pub. Date: Sep. 25, 2008

(65) Prior Publication Data

US 2010/0038278 A1 Feb. 18, 2010

(30) Foreign Application Priority Data

Mar. 12, 2007 (FR) ..... 0753757

(51) Int. Cl.
*A45C 13/10* (2006.01)

(52) U.S. Cl. ..... 206/1.5; 206/0.82; 206/536; 206/538

(58) Field of Classification Search ..... 206/531, 206/0.82, 0.83, 1.5, 536, 532, 538
See application file for complete search history.

(56) References Cited

U.S. PATENT DOCUMENTS

| | | | | |
|---|---|---|---|---|
| 4,120,400 | A * | 10/1978 | Kotyuk | 206/528 |
| 6,341,710 | B1 * | 1/2002 | Danielson et al. | 220/281 |
| 6,848,577 | B2 * | 2/2005 | Kawamura et al. | 206/449 |
| 2004/0055903 | A1 * | 3/2004 | Nishimura | 206/1.5 |
| 2004/0114320 | A1 * | 6/2004 | Williams et al. | 361/685 |
| 2005/0082194 | A1 * | 4/2005 | Fry et al. | 206/531 |
| 2005/0139605 | A1 * | 6/2005 | Benktzon et al. | 221/25 |
| 2007/0045150 | A1 * | 3/2007 | Huffer et al. | 206/538 |

FOREIGN PATENT DOCUMENTS

WO 2007/021787 2/2007

OTHER PUBLICATIONS

International Search Report dated Jun. 4, 2008, from corresponding PCT application.

* cited by examiner

*Primary Examiner* — David Fidei
*Assistant Examiner* — Raven Collins
(74) *Attorney, Agent, or Firm* — Young & Thompson

(57) ABSTRACT

A protection sleeve for a drug blister, includes a horizontal drawer holding the blister, a sheath inside which the drawer is mounted so as to be capable of sliding between a closed position and an open position, and first locking elements for locking the drawer in a closed position, that include at least a first transverse face for blocking the drawer and to be arranged against a second transverse face for blocking the sheath when the drawer is in the closed position, the first blocking face being provided on a segment of the drawer mounted so as to pivot about a longitudinal axis between a locking angular position and a release angular position, characterized in that at least one of the blocking face is supported by an elastically deformable locking tab so that the locking can be achieved by the elastic engagement of the tab behind the other blocking face.

14 Claims, 5 Drawing Sheets

BLISTER PROTECTION SLEEVE INCLUDING AUTOMATIC LOCKING MEANS THAT CAN BE UNLOCKED BY TORSION

The invention relates to a case for a medication blister card comprising a drawer sliding in a sheath and comprising means for locking the drawer in the closed position.

The invention relates more particularly to a protective case of a blister card containing medication which comprises:

- a horizontal drawer which comprises means for supporting the blister card;
- a sheath inside which the drawer is mounted so as to slide longitudinally between a closed position in which the blister card cannot be accessed and an open position in which the blister card can be accessed;
- first means for locking the drawer in the closed position which comprise at least a first transverse immobilization face which is supported by the drawer and which is designed to be arranged against a second transverse face for immobilizing the sheath when the drawer is in the closed position in order to prevent the drawer from sliding to its open position;
- the first immobilization face being arranged on a section of the drawer which is mounted so as to pivot relative to the means for supporting the blister card of the drawer about a longitudinal axis between an angular locked position in which the first immobilization face is opposite the second immobilization face when the drawer is in the closed position and to which the pivoting section is elastically returned, and an angular unlocked position in which the first immobilization face is offset in a vertical transverse plane relative to the second immobilization face in order to allow the drawer to slide to its open position.

Certain medication is delivered in blister cards in a case in which is included an information leaflet concerning the medication that it contains.

A blister card usually comprises a semirigid horizontal top plate comprising cavities in the form of blisters delimiting downward open housings which are closed off by lids and which each contain a medication capable of being pushed out through the bottom flat face of the blister card by tearing the lid of the blister card.

The medication contained in this case is likely to be dangerous if it is ingested accidentally for example by children. In certain countries, standards require that the case enclosing the blister card is fitted with safety devices which prevent children from having access to the medication.

Already known are many means for complicating the opening of the case in order to prevent children from opening the latter.

Amongst these means, it is known practice to fit the case with locking means which require a certain dexterity on the part of the user to be unlocked.

Document U.S. Pat. No. 4,120,400 describes, for example, a case for storing the blister card by longitudinal sliding through a front opening of the case. The blister card comprises two side orifices which are arranged at the front of the blister card.

The case is furnished with associated tabs which are arranged in correspondence with the orifices. The tabs are more particularly arranged on either side of the front opening of the case. One of the tabs extends upward while the other extends downward.

To slide the blister card out of the sheath, a user is obliged to twist the blister card in order to remove the tabs from the orifices, while simultaneously pulling the blister card in order to make it slide longitudinally forward. This combination of manipulations is difficult for a child to achieve. The opening operation is thereby made secure.

However, to put away the blister card in its case, the user must again carry out a twisting movement, which complicates the operation of putting away. Certain users might then choose not to put the blister card away for reasons of ease of use or quite simply omit to check that the blister card is properly locked in the closed position.

In particular to solve this problem, the invention proposes a case of the type described above, characterized in that at least one of the immobilization faces is supported by a locking tab that is elastically deformable so that the locking takes place by elastic snap-fitting of the tab behind the other immobilization face, the pivoting section of the drawer being in an angular locked position.

According to other features of the invention:

- the pivoting end section of the drawer is connected to the means for supporting the blister card by an intermediate section that is torsionally elastically deformable;
- the intermediate section forms a plate;
- the pivoting end section and the intermediate torsion section are made in one piece of the same material with the means for supporting the blister card;
- the drawer is made of a rigid plastic material such as polypropylene;
- the pivoting end forms the façade of the drawer;
- the locking tabs are arranged on the pivoting section;
- the case comprises second means for locking the drawer in the closed position;
- the second locking means comprise at least one lever which is arranged laterally in the sheath, the lever being able to move between an angular immobilization position in which a free end of the lever is interlocked in a corresponding notch of the drawer when the drawer is in the closed position and to which the lever is returned elastically, and a released position in which the free end of the lever is no longer engaged in the notch so as to allow the drawer to slide to its open position;
- the second locking means comprise two levers which are arranged in opposition in the sheath so as to be able to be actuated simultaneously to their angular released position by pinching between the fingers of one hand.

Other features and advantages will appear when reading the following detailed description for the understanding of which reference will be made to the appended drawings, amongst which:

Figure 1:
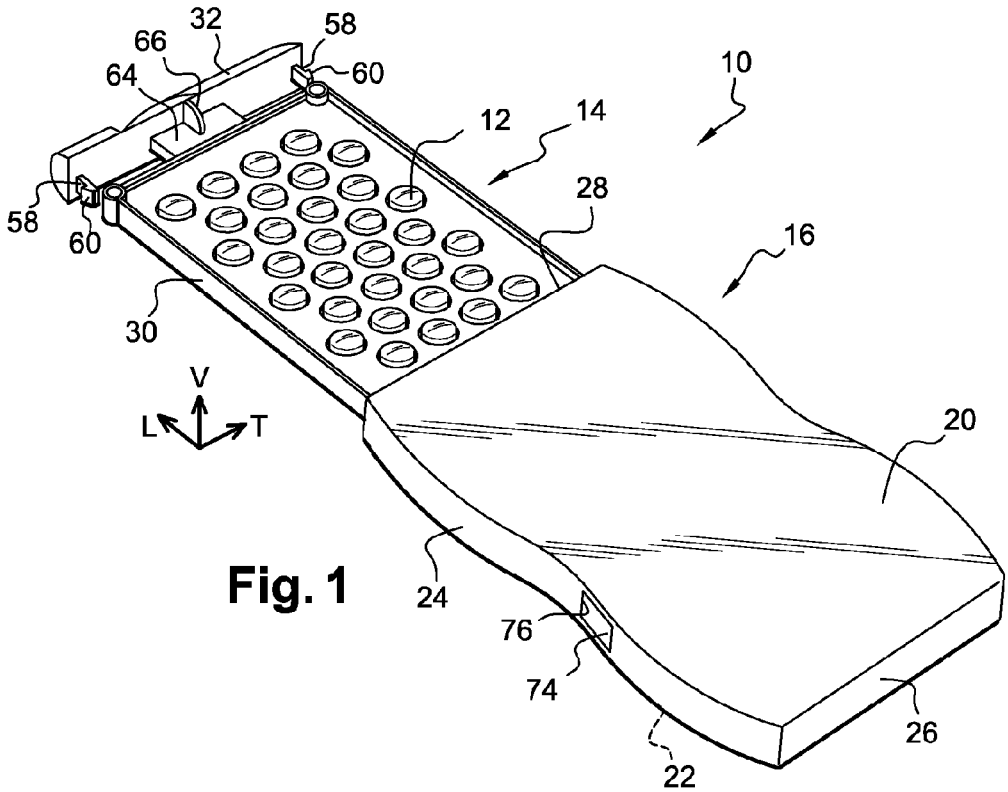
FIG. 1 is a view in perspective which represents a protective case made according to the teachings of the invention and which comprises a drawer which supports a blister card and a sheath for putting away the drawer.

In a nonlimiting manner in the rest of the description and in the claims, a longitudinal, vertical and transverse orientation will be adopted indicated by the trihedron "L,V,T" of FIG. 1.

In what follows, identical, analogous or similar elements will be indicated by the same reference numbers.

FIG. 1 shows a case 10 for protecting a blister card 12 for medication.

The case 10 mainly comprises a horizontal drawer 14 which is mounted so as to slide longitudinally in a sheath 16. The drawer 14 comprises a horizontal bottom 30 to support the blister card 12.

Figure 3:
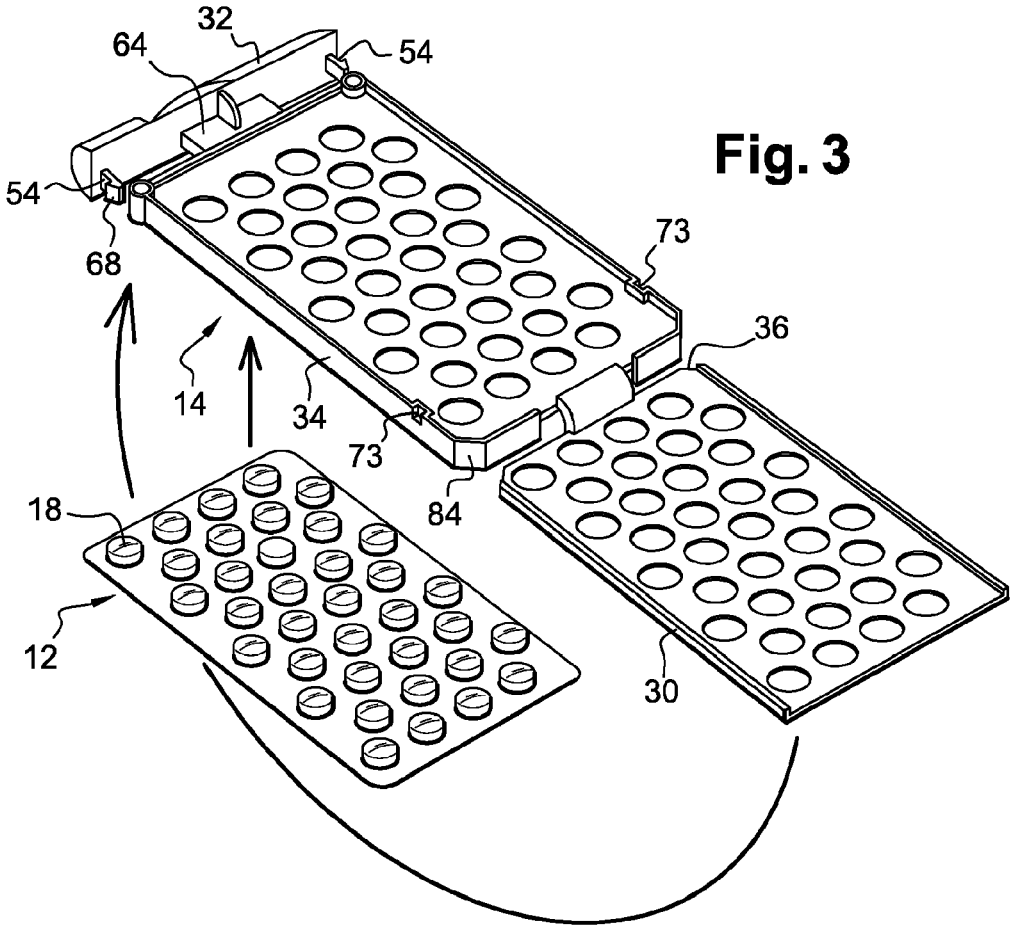
FIG. 3 is an exploded view in perspective which represents the drawer and the blister card.

In a known manner and as shown in FIG. 3, the blister card 12 comprises a semirigid horizontal top plate which comprises cavities 18, in the form of blisters delimiting housings that are open downward and that are closed off by bottom lids (not shown). Each of the housings can accommodate a medication capable of being pushed out through the bottom flat face of the blister card 12 by deforming the cavity 18 and by tearing the lid. The medication is packaged for example in the form of pills, gelatin capsules or suppositories capable of being protected by a blister card 12.

Figure 2:
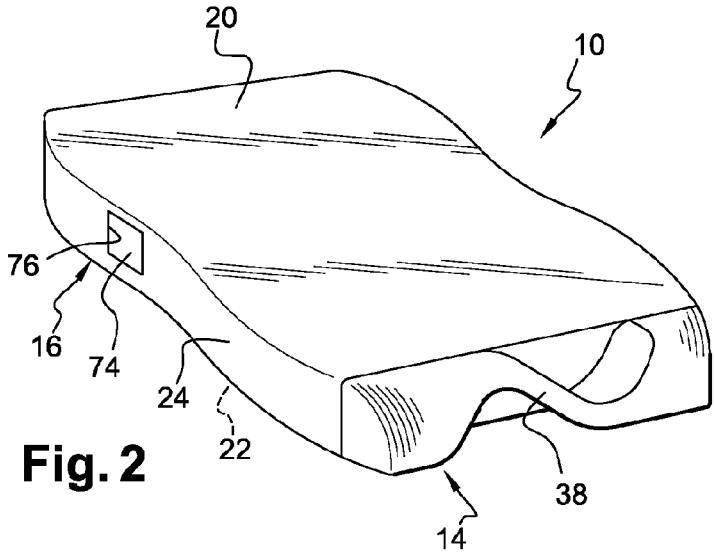
FIG. 2 is a view in perspective in opposition to that of FIG. 1 which represents the drawer in the closed position inside the sheath.

The drawer 14 is capable of sliding between a rear closed position in which the cavities 18 of the blister card 12 are housed in the sheath 16 so as to be inaccessible to a user, as shown in FIG. 2, and a front open position in which the cavities 18 of the blister card 12 are accessible to a user, as illustrated in FIG. 1.

The sheath 16 in this instance has the form of a generally parallelepipedal box which is delimited by a top horizontal wall 20, a bottom horizontal wall 22, two lateral vertical longitudinal edges 24 and a rear transverse vertical edge 26. The front edge of the sheath 16 comprises a front opening 28 which is capable of receiving the drawer 14 by sliding.

The transverse width of the sheath 16 is advantageously adapted to fit into the palm of the hand of a user between the thumb on the one hand and the other fingers on the other hand. In particular, to improve the handling of the sheath 16, the lateral edges 24 in this instance show a double curve that is concave in the middle of the edge 24 and convex at the two end sections of the lateral edges 24.

As shown in FIG. 3, the drawer 14 mainly comprises a horizontal bottom 30 of rectangular shape which is designed to support the blister card 12 and a front façade 32 which is capable of totally closing the opening 28 of the sheath 16 when the drawer 14 is in its closed position.

In the embodiment shown in FIG. 3, the case 10 is fitted with a device for trapping the blister card 12 in the drawer 14. Such a device is, for example, used when the medication has to be the subject of clinical tests. Such a device comprises a flap 34 which is intended to be attached irremovably to the top surface of the bottom 30 while trapping the blister card 12. This device is described in greater detail in document WO-A-2004/035414 and will therefore not be developed below.

The façade 32 of the drawer 14 is in this instance attached to a front edge of the flap 34.

According to a variant of the invention that is not shown, the façade 32 of the drawer 14 is attached to a front edge of the bottom 30.

The flap 34 is in this instance mounted so as to pivot about a rear transverse hinge 36 via its rear edge on the rear edge of the bottom 30.

As shown in FIG. 2, the front façade 32 advantageously comprises a handle 38 so that a user can take hold of the handle 38 in order to slide the drawer 14 between its two positions.

Figure 6A:
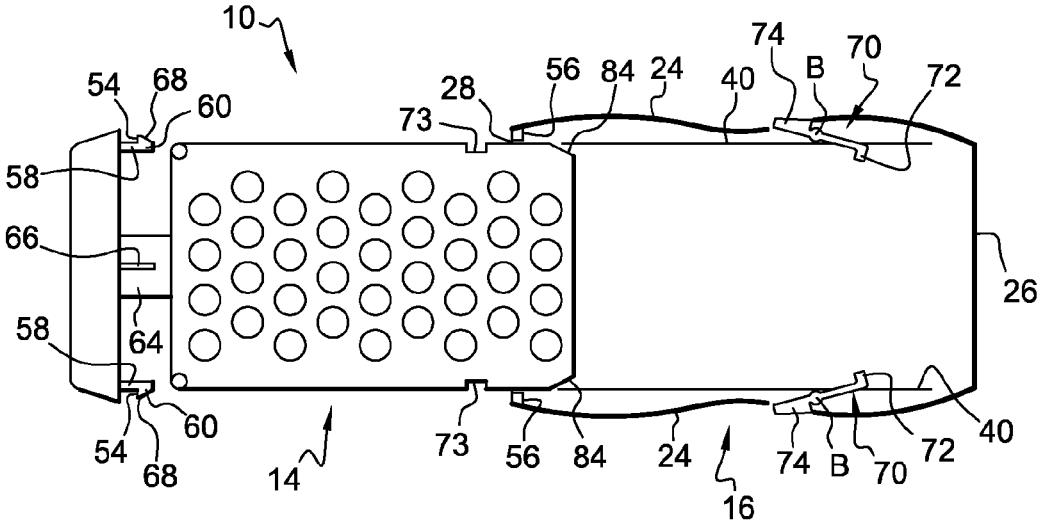
FIG. 6A is a schematic top view in horizontal section which represents the drawer in the open position in the sheath.
Figure 6B:
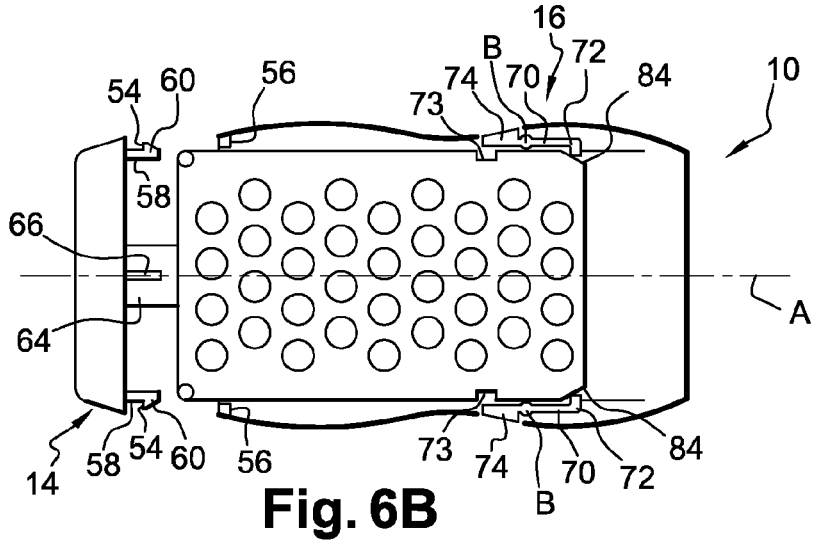
FIG. 6B is a view similar to that of FIG. 6A which represents the drawer in an intermediate position when it is being slid to its closed position.
Figure 6C:
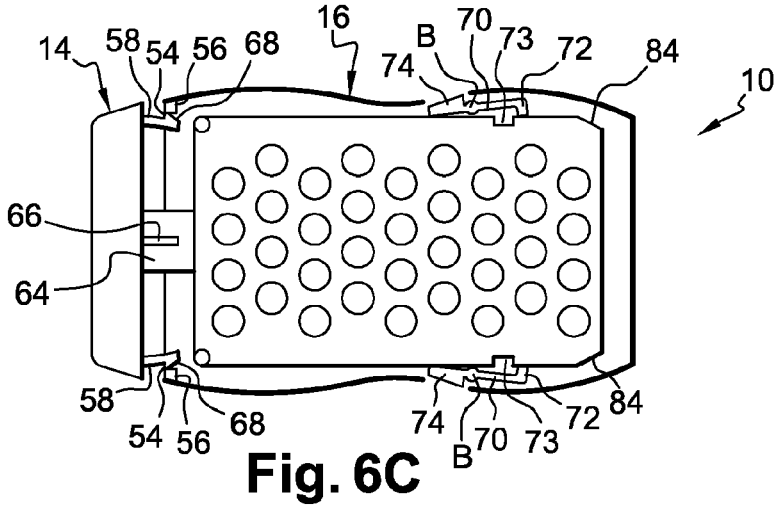
FIG. 6C is a view similar to that of FIG. 6A which represents the drawer when it is slid to its closed position just before reaching its closed position.
Figure 6D:
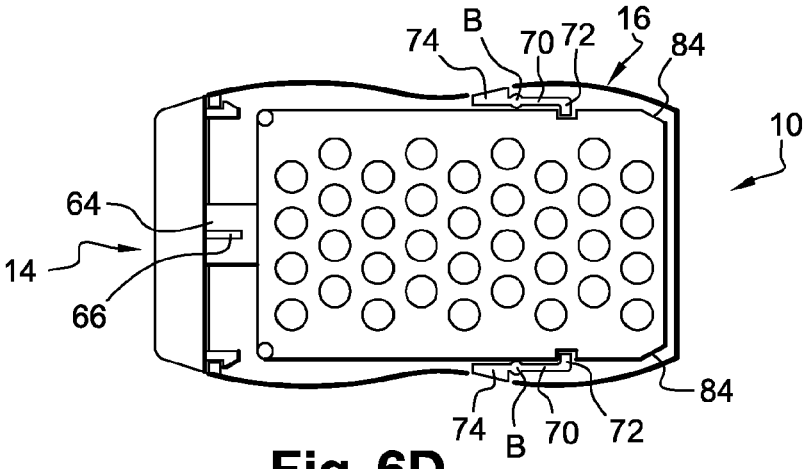
FIG. 6D is a view similar to that of FIG. 6A which represents the drawer in the closed position in the sheath.
Figure 7:
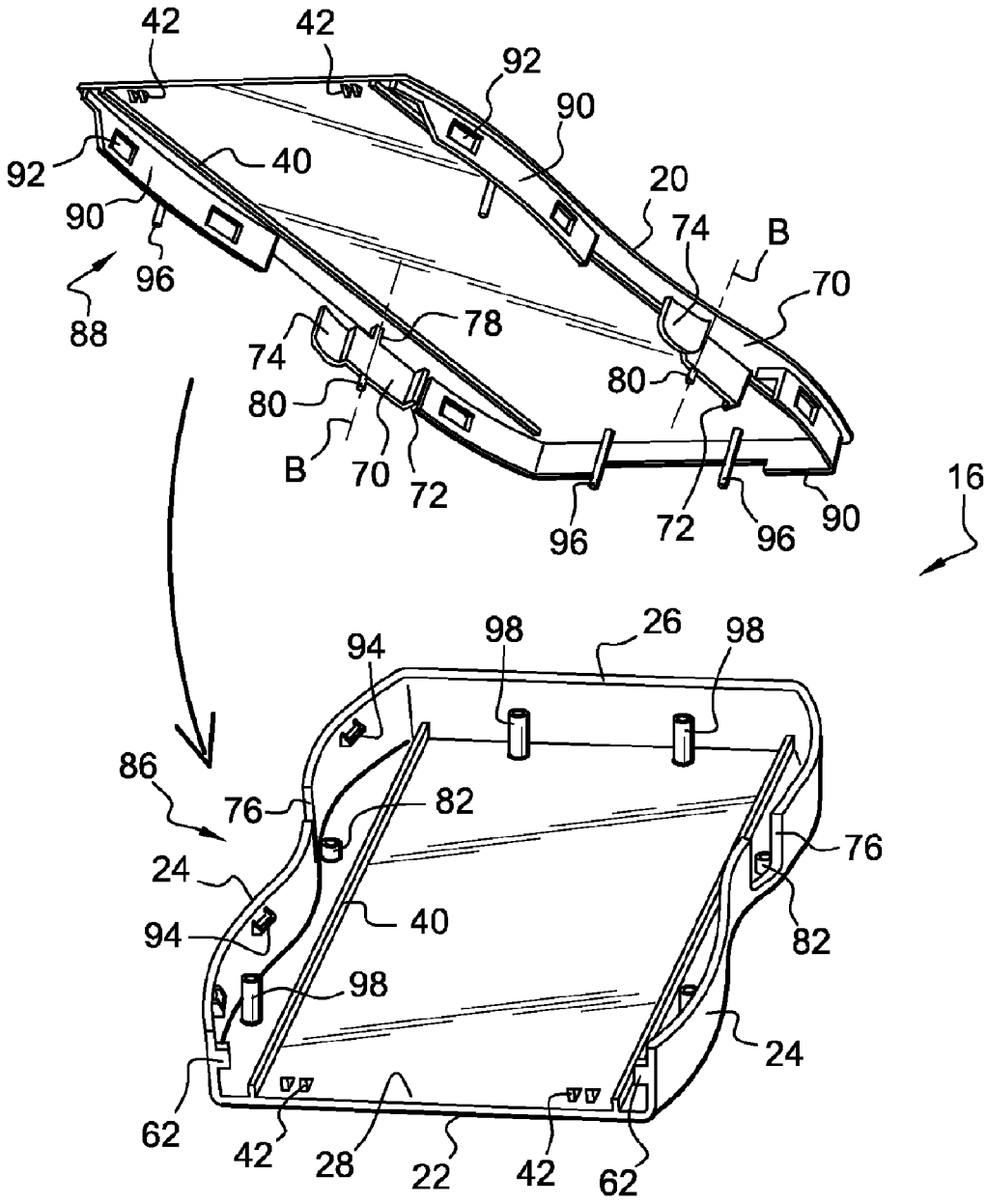
FIG. 7 is an exploded view in perspective which represents the sheath of FIG. 1 comprising two half-shells.

To make the drawer 14 slide easily in the sheath 16, the inside face of the bottom horizontal wall 22 and the inside face of the top horizontal wall 20 of the sheath 16 comprise pairs of longitudinal rails 40 against which the parallel lateral edges of the bottom 30 of the drawer 14 are designed to slip when sliding, as shown in FIGS. 6A to 7. Therefore, the drawer 14 cannot be placed the wrong way round between the curved edges of the sheath 16 and prevent the sliding. The rails 40 are in this instance formed by a longitudinal rib which extends vertically protruding toward the inside of the sheath 16.

Figure 4:
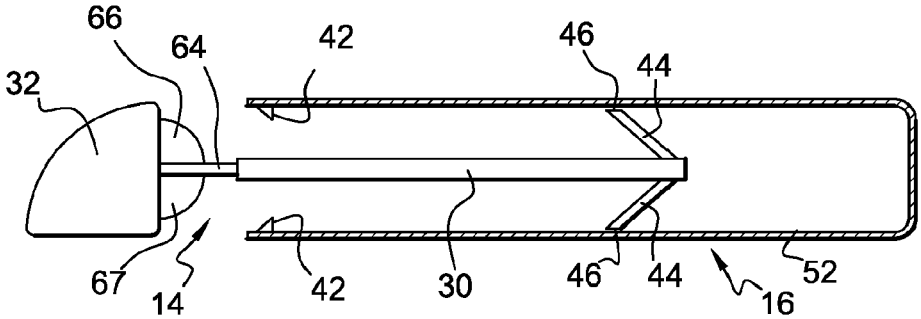
FIG. 4 is a view in vertical longitudinal section which represents the drawer in an intermediate position inside the sheath.

As shown in FIG. 4, the sheath 16 also comprises a stop 42 in order to stop the forward sliding of the drawer 14 in its open position, and thus prevent the drawer 14 from coming completely out of the sheath 16 when it is pulled toward its open position. Accordingly, the sheath 16 comprises protrusions 42 which each support a vertical shoulder face 42 which is oriented rearward and which forms a stop. The protrusions 42 extend toward the inside of the sheath 16 from the inside faces of the top wall 20 and bottom wall 22.

The protrusions 42 are in this instance four in number. Thus the inside face of the top wall 20 comprises two protrusions 42 and the inside face of the bottom wall 22 comprises the two other protrusions 42. The top protrusions 42 are more particularly arranged vertically facing the bottom protrusions 42 close to the opening 28.

The drawer 14 comprises abutment tongues 44 which extend vertically beneath and above the bottom 30 from a fitted end to a free end 46. The free end 46 of the abutment tongues 44 is capable of butting against the shoulder faces of the protrusions 42 of the sheath 16 when the drawer 14 is in its open position.

The abutment tongues 44 are elastically deformable by bending in order to make it easier to install the drawer 14 in the sheath 16. Each tongue 44 is inclined toward the front relative to the fitted end. Therefore, when the drawer 14 is installed in the sheath 16, the body of the tongues 44 comes into contact with the protrusions 42 of the sheath 16 via a front face of the tongue 44. Each tongue 44 being inclined toward the front, it slips on the associated protrusion 42 while bending toward the bottom 30 of the drawer 14 so as to get past the associated protrusion 42.

When the drawer 14 thus installed is slid toward its open position, the tongues 44 come into contact with the shoulder face of the protrusions 42 via their free end 46. Because the tongues 44 are inclined, the free end 46 of each tongue 44 slips on the shoulder face 42 vertically toward the base of the protrusion 42, causing the tongues 44 to spread so as to wedge the free ends 46 of the tongues 44 in the corner formed by the shoulder face 42 and the inside face of the corresponding wall 20, 22, thereby strengthening the immobilization of the drawer 14 in abutment.

The drawer 14 is thus advantageously linked in an indissociable and irremovable manner to the sheath 16. The sheath 16 can therefore not be lost or exchanged with the sheath of another similar case. This is particularly useful for carrying out clinical tests for which the sheaths can be fitted with a notice or information on the composition of the medication enclosed in the blister card 12.

The case 10 also comprises first means for locking the drawer 14 in the closed position particularly in order to prevent children from having access to the medication.

The first locking means comprise at least a first vertical transverse immobilization face 54 which is supported by the drawer 14. The first vertical transverse immobilization face 54 is oriented toward the front.

The first locking means also comprise at least a second vertical transverse immobilization face 56 which is supported by the sheath 16 and which is oriented toward the rear.

The first immobilization face 54 is designed to be pressed longitudinally against the second associated transverse immobilization face 56 of the sheath 16 when the drawer 14 is in the closed position in order to prevent the drawer 14 from sliding to its open position.

The drawer 14 in this instance comprises two first immobilization faces 54. The first immobilization faces 54 are supported by locking tabs 58 which extend longitudinally rearward from the rear transverse vertical face of the façade 32. The free end of each locking tab 58 forms more particularly a head 60 which supports the first immobilization face 54. The first immobilization face 54 is thus arranged opposite to and at a distance from the rear face of the façade 32 of the drawer 14.

The locking tabs 58 are more particularly arranged at the two transverse ends of the rear face of the façade 32, substantially at the same level as the bottom 30 of the drawer 14, the heads 60 being turned in opposition to one another transversely toward the outside.

The sheath 16 comprises two second immobilization faces 56 which are each associated with one of the first immobilization faces 54 and which in this instance are supported by locking protrusions 62 which extend transversely toward the inside of the sheath 16 from the inside face of the lateral edges 24.

Figure 5A:
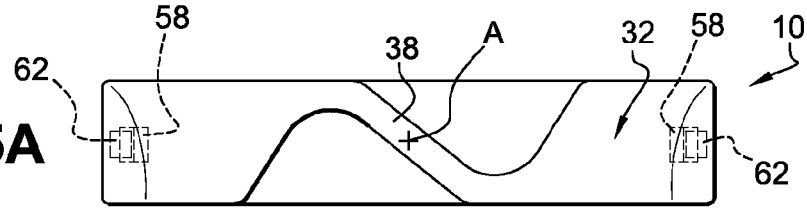
FIG. 5A is a front view which represents the pivoting façade of the drawer in its locked position.
Figure 5B:
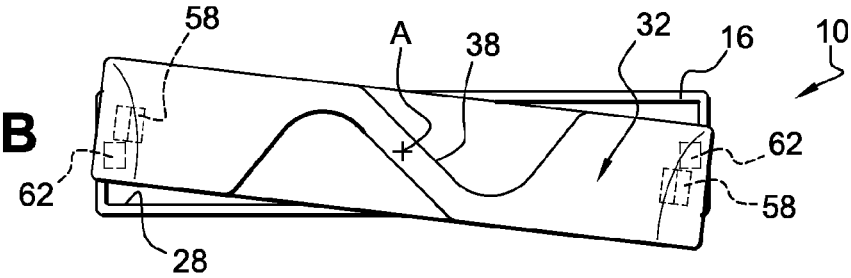
FIG. 5B is a view similar to that of FIG. 5A which represents the pivoting façade of the drawer in an unlocked position.

The façade 32 of the drawer 14 is mounted so as to pivot relative to the bottom 30 of the drawer 14 about a longitudinal axis "A" between:

- an angular locked position in which the first immobilization face 54 is opposite the second immobilization face 56 when the drawer 14 is in the closed position, as shown in FIG. 5A, and
- an angular unlocked position in which the first immobilization face 54 is completely offset in a vertical transverse plane relative to the second immobilization face 56 in order to allow the drawer 14 to slide to its open position, as shown in FIG. 5B.

As shown in FIGS. 5A, 5B and 6B, the pivoting axis "A" is in this instance a midline relative to the bottom 30 of the drawer 14 and to the façade 32 of the drawer 14.

As shown in FIG. 5A, the angular locked position corresponds to a horizontal position of the façade 32. The façade 32 is returned elastically to this angular locked position.

Accordingly, the drawer 14 comprises an intermediate section 64 that is torsionally elastically deformable about the longitudinal pivoting axis "A" which will hereinafter be called the torsion section 64.

The torsion section 64 is in this instance formed by a horizontal plate which comprises a rear end edge which is mechanically connected via a flush-fitting connection with a front edge of the bottom 30 of the drawer 14. The torsion section 64 also comprises a front end edge which is mechanically connected via a flush-fitting connection with the rear face of the façade 32 of the drawer 14.

The transverse width of the torsion section 64 is less than the transverse width of the bottom 30, and its longitudinal length is greater than the length of the locking tabs 58. Therefore, the locking tabs 58 can advantageously be arranged in the alignment of the lateral edges of the bottom 30 against the façade 32 without interference with the bottom 30 of the drawer 14 so that the heads 60 protrude transversely relative to the lateral edges of the bottom 30 of the drawer 14. The first immobilization faces 54 are thus arranged transversely between the rail 40 and the associated lateral edge 24.

The torsion section 64 is in this instance made of a plastic material having great flexibility. For the torsion section 64 to be sufficiently flexible and strong in torsion, the torsion section 64 comprises two longitudinal vertical ribs, a top rib 66 and bottom rib 67, for stiffening the torsion section 64 which connects the torsion section 64 to the façade 32 of the drawer 14. The top rib 66, respectively bottom rib 67, extends upward, respectively downward, from the middle of the top face, respectively bottom face, of the torsion section 64. Each rib 66, 77 extends in the form of a flying buttress between the rear vertical face of the façade 32 and the associated face of the torsion section 64.

The torsion section 64 is therefore designed so as to have sufficient rigidity to dissuade children from pivoting the façade 32, but to be sufficiently flexible for adults to be able to easily pivot the façade 32.

The locking tabs 58 of the drawer 14 are flexionally elastically deformable so that the drawer 14 is automatically locked when the drawer 14 is slid to its closed position by elastic snap-fitting of the head 60 of the locking tab 58 behind the other immobilization face.

During this locking operation, the pivoting façade 32 of the drawer 14 is in an angular locked position and does not need to be pivoted to its angular unlocked position.

The free end of the locking tabs 58 and/or the corresponding locking protrusions 62 comprise guide ramps 68 which guide the flexing of the locking tabs 58. Therefore, the guide ramps 68 are inclined relative to the transverse direction.

Advantageously, the first locking means are supplemented by second locking means.

The second locking means in this instance comprise two levers 70 of generally longitudinal orientation which are arranged inside the sheath 16 close to the lateral edges 24. Each lever 70 is mounted so as to pivot about a vertical pivoting axis "B" between an angular immobilization position and an angular released position.

The levers 70 are arranged in the space delimited between the rear convex curve of the lateral edges 24 of the sheath 16 and the associated rail 40, thereby offering sufficient space for the range of movement of the levers 70.

Each lever 70 comprises an immobilization end 72 which is designed to be interlocked in a matching notch 73 which is supported by the corresponding lateral edge of the drawer 14 when the drawer 14 is in the closed position and the lever 70 is in the angular immobilization position in order to prevent the drawer 14 from sliding to its open position.

The lever 70 also comprises a second pressure end 74. The pivoting axis "B" is in this instance arranged between the pressure end 74 and the immobilization end 72. Therefore, when a user presses on the pressure end 74 transversely toward the inside of the sheath 16, the lever 70 is pivoted to its released position in which the immobilization end 72 is moved transversely toward the outside so as to come out of the corresponding notch 73 in order to release the drawer 14 to slide.

In order to make the pressure end 74 of the lever 70 accessible, the lateral edges 24 of the sheath 16 comprise access windows 76 which are arranged to coincide with the pressure ends 74.

To improve the ease of use and user-friendliness of the case 10, the pressure ends 74 are arranged close to the middle of the lateral edges 24 of the sheath 16.

To automate the locking of the second locking means when the drawer 14 is slid to its closed position, the lever 70 is elastically returned to its angular immobilization position.

Accordingly, at least one end 78 of the axis "B", in this instance the top end, is connected via a flush-fitting connection with the sheath 16 while the other end 80 of the axis "B" is mounted so as to pivot in a bottom bearing 82, as shown in FIG. 7. The flush-fitting section of axis "B" 78 is torsionally elastically deformable. In this instance, the flush-fitting section 78 is made of a plastic material and has a square horizontal section in order to reduce the torsional stiffness without weakening the strength of the flush-fitting section 78.

In addition, the rear tops 84 of the bottom 30 of the drawer 14 are bevel-shaped so as to form guide planes in order to prime the levers 70 in the released position when the drawer 14 is slid to its closed position.

According to a variant of the invention that is not shown, the second locking means comprise two elastically deformable longitudinal claws which are arranged transversely on either side of the drawer. Each claw comprises one end flush-fitted into the drawer and one immobilization free end. The sheath 16 comprises two windows which are arranged in correspondence with the immobilization free ends of the claws when the drawer 14 is in the closed position, so that the immobilization free ends are engaged in the associated windows in order to prevent the drawer 14 from sliding. The free ends of the claws are elastically returned outward. Unlocking is obtained by pressing on the free ends of the claws against their elastic return force in order to push them inside the sheath 16 releasing the windows in order to allow the drawer 14 to slide.

The operation for locking the drawer 14 is now described.

When the drawer 14 is in the open position, as shown in FIG. 6A, the façade 32 of the drawer 14 is held in its locked position by the elastic return torque of the torsion section 64 and the levers 70 are held elastically in their angular immobilization position.

The user begins to push on the façade 32 in order to slide the drawer 14 longitudinally rearward. The bottom 30 of the drawer 14 then slides between the rails 40.

As shown in FIG. 6B, when the rear end of the drawer 14 reaches the immobilization end 72 of the levers 70, the levers 70 are pushed toward their angular released position by the guide planes 84 of the rear end of the lateral edges of the bottom 30 of the drawer 14.

Then the immobilization ends 72 of the levers 70 slip resting against the rectilinear lateral edges of the bottom 30, the levers 70 thus being held in their angular released position.

As shown in FIG. 6C, when the façade 32 is close to the sheath 16, the heads 60 of the locking tabs 58 come into contact with the locking protrusions 62 by means of their guide ramp 68. Continuing the longitudinal slide, the guide ramps 68 slip over the locking protrusions 62 causing the locking tabs 58 to flex transversely toward one another in order to get round the associated locking protrusion 62.

As shown in FIG. 6D, when the drawer 14 reaches abutment in its closed position, the heads 60 are then elastically snap-fitted behind the second immobilization face 56 of the locking protrusions 62.

Simultaneously, the immobilization ends of the levers 70 are elastically returned to their angular immobilization position in the lateral notches 73.

When the user wishes to pull the drawer 14 to its open position, he must simultaneously pinch the two pressure ends 74 of the levers 70 between their fingers in order to operate the levers 70 to their released position, and twist the façade 32 of the drawer 14 into its angular unlocked position in order to cause the vertical offsetting of the heads 60 relative to the locking protrusions 62.

While maintaining these forces, the user must then pull the façade 32 of the drawer 14 longitudinally in order to make the drawer 14 slide forward.

If one of the two locking devices is not correctly actuated, the drawer 14 is held in its closed position. According to an advantageous embodiment of the invention, the sheath 16 and the drawer 14 are made of a molded rigid plastic material, for example of polypropylene.

More particularly, the drawer 14, that is to say the bottom 30, the flap 34, the hinge, the torsion section 64 and the façade 32, is molded in a single piece. The elasticity of the torsion section 64 is conferred by a thinness of the plastic material.

As shown in FIG. 7, the sheath 16 is made by molding two half-shells, a bottom shell 86 and top shell 88, which are then assembled, for example by vertical elastic interlocking of complementary shapes.

More particularly, the top half-shell 88 in this instance comprises the top wall 20 and the levers 70 which are made of the same material and in one piece. Accordingly, the top end of the levers 70 is in this instance attached via a flush-fitting connection in the inside face of the top wall 20. The bottom end of the pivoting axes "B" which in this instance has a circular section is designed to be received in a matching bearing 82 of the bottom half-shell 86.

The top half-shell 88 also comprises a skirt 90 which comprises openings 92. The skirt 90 is designed to be interlocked vertically inside the bottom half-shell 86 along the lateral edges 24.

The inside face of the lateral edges 24 comprises fastening claws 94 which are designed to be received by elastic interlocking in the openings 92 of the skirt 90 of the top half-shell 88 for the irremovable attachment of the two half-shells 86, 88 to one another.

In addition, the top half-shell 88 comprises positioning pins 96 which are designed to be received in tubular stays 98 of the bottom half-shell 86.

Producing the protective case 10 in rigid plastic advantageously makes it possible to obtain very strong protection against assaults and impacts.

In addition, exposing the case 10 to liquid substances does not soften the case 10 as may occur for a case made of cardboard.

Such a case 10 in particular makes it possible to trap the blister card 12 between a bottom 30 and a very rigid and strong flap 34 while allowing the façade 32 of the drawer 14 to pivot via the torsion section 64.

The rigid material forming the sheath 16 is an additional safety element to prevent children from gaining access to the medication by damaging the sheath.

The invention claimed is:

1. A protective case (10) of a blister card (12) containing medication, said protective case comprising:

a horizontal drawer (14) which comprises a support (30, 34) supporting the blister card (12);

a sheath (16) inside which the drawer (14) is mounted so as to slide longitudinally between a closed position in which the blister card (12) cannot be accessed and an open position in which the blister card (12) can be accessed; and first locking element for locking the drawer (14) in the closed position which comprise at least a transverse first immobilization face (54) which is supported by the drawer (14) and which is designed to be arranged against a second transverse face (56) for immobilizing the sheath (16) when the drawer (14) is in the closed position in order to prevent the drawer (14) from sliding to its open position;

the first immobilization face (54) being arranged on a section (32) of the drawer (14) which is mounted so as to pivot relative to the support (30) supporting the blister card (12) of the drawer (14) about a longitudinal axis (A) between an angular locked position in which the first immobilization face (54) is opposite the second immobilization face (56) when the drawer (14) is in the closed position and to which the pivoting section (32) is elastically returned, and an angular unlocked position in which the first immobilization face (54) is offset in a vertical transverse plane relative to the second immobilization face (56) in order to allow the drawer (14) to slide to its open position;

wherein at least one of the immobilization faces (54) is supported by a locking tab (58) that is elastically deformable so that the locking takes place by elastic snap-fitting of the tab (58) behind the other immobilization face (56), the pivoting section (32) of the drawer (14) being in an angular locked position, and wherein the pivoting end section (32) of the drawer (14) is connected to the support (30) supporting the blister card (12) by an intermediate section (64) that is torsionally elastically deformable.

2. The case (10) as claimed in claim 1, wherein the intermediate section (64) forms a plate.

3. The case (10) as claimed in claim 1, wherein the pivoting end section (32) and the intermediate torsion section (64) are made in one piece of the same material with the support (30) supporting the blister card (12).

4. The case (10) as claimed in claim 3, wherein the drawer (14) is made of a rigid plastic material such as polypropylene.

5. The case (10) as claimed in claim 1, wherein the pivoting end (32) forms the façade (32) of the drawer (14).

6. The case (10) as claimed in claim 1, wherein the locking tabs (58) are arranged on the pivoting section (32).

7. The case (10) as claimed in claim 1, further comprising a second locking element (70, 73) for locking the drawer (14) in the closed position.

8. The case (10) as claimed in claim 7, wherein the second locking element comprises at least one lever (70) which is arranged laterally in the sheath (16), the lever (70) being able to move between an angular immobilization position in which a free end (72) of the lever (70) is interlocked in a corresponding notch (73) of the drawer (14) when the drawer (14) is in the closed position and to which the lever (70) is returned elastically, and a released position in which the free end (72) of the lever (70) is no longer engaged in the notch (73) so as to allow the drawer (14) to slide to its open position.

9. The case (10) as claimed in claim 8, wherein the second locking element comprises two levers (70) which are arranged in opposition in the sheath so as to be able to be actuated simultaneously to their angular released position by pinching between the fingers of one hand.

10. The case (10) as claimed in claim 2, wherein the pivoting end section (32) and the intermediate torsion section (64) are made in one piece of the same material with the support (30) supporting the blister card (12).

11. The case (10) as claimed in claim 10, wherein the drawer (14) is made of a rigid plastic material such as polypropylene.

12. The case (10) as claimed in claim 1, wherein the pivoting end (32) forms the façade (32) of the drawer (14).

13. The case (10) as claimed in claim 1, wherein the locking tabs (58) are arranged on the pivoting section (32).

14. The case (10) as claimed in claim 1, further comprising a second locking element (70, 73) for locking the drawer (14) in the closed position.

* * * * *